US005177333A

United States Patent [19]

Ogasawara

[11] Patent Number: 5,177,333

[45] Date of Patent: Jan. 5, 1993

[54] HIGH FREQUENCY COOKING DEVICE HAVING ELECTROMAGNETIC INDUCTION HEATER

[75] Inventor: Toshio Ogasawara, Saitama, Japan

[73] Assignees: Mitsubishi Denki Kabushiki Kaisha, Tokyo; Mitsubishi Electric Home Appliance Co., Ltd., Saitama, both of Japan

[21] Appl. No.: 713,203

[22] Filed: Jun. 11, 1991

[30] Foreign Application Priority Data

Jul. 5, 1990 [JP] Japan ..... 2-176269

[51] Int. Cl.[5] ..... H05B 6/64

[52] U.S. Cl. ..... 219/10.55 F; 219/10.55 B; 219/10.55 M; 219/10.55 R; 219/10.493; 219/10.75; 219/10.79

[58] Field of Search ..... 219/10.55 F, 10.55 R, 219/10.55 A, 10.55 B, 10.55 E, 10.493, 10.491, 10.69, 10.75, 10.79; 99/DIG. 14, 327, 348

[56] References Cited

U.S. PATENT DOCUMENTS

| | | | |
|---|---|---|---|
| 2,648,514 | 8/1953 | Rosier et al. | 99/348 |
| 3,808,391 | 4/1974 | Graff et al. | 219/10.55 F |
| 4,481,396 | 11/1984 | Matsubayashi et al. | 219/10.55 B |
| 4,984,512 | 1/1991 | Takahashi et al. | 99/327 |
| 5,045,659 | 9/1991 | Wolfe et al. | 219/10.55 E |

FOREIGN PATENT DOCUMENTS

| | | |
|---|---|---|
| 053189 | 6/1982 | European Pat. Off. . |
| 199264 | 10/1986 | European Pat. Off. . |
| 291093 | 11/1988 | European Pat. Off. . |
| 318645 | 6/1989 | European Pat. Off. . |
| 2546261 | 4/1976 | Fed. Rep. of Germany . |
| 2301150 | 9/1976 | France . |
| 2633483 | 12/1989 | France . |

*Primary Examiner*—Bruce A. Reynolds
*Assistant Examiner*—Tu Hoang
*Attorney, Agent, or Firm*—Sughrue, Mion, Zinn, Macpeak and Seas

[57] ABSTRACT

A cooking heater comprises a housing provided thereon with an operation control panel including a plurality of function keys, a cooking room disposed in the housing, the cooking room having a bottom formed by a non-magnetic metal mesh having a size in a range from 10 mesh to 25 mesh, a turntable disposed within the heating room for containing food to be cooked, magnetron for generating microwaves, a wave guide for guiding said microwaves into the cooking room, an electromagnetic induction coil disposed below the non-magnetic metal mesh, and means for selectively coupling electric power to the magnetron or the induction coil. The non-magnetic metal mesh may be sandwiched between two layers of dielectric material to form a laminated structure to thereby absorb any thermal deformation of the mesh. The turntable is preferbly formed of dielectric material. The cooking heater may further comprise a warning means for setting a preheating time and producing an audible warning signal when the preheating time elapses, and the funtion keys may include a preheating key such that the warning means is actuated by depression of the preheating key.

5 Claims, 2 Drawing Sheets

HIGH FREQUENCY COOKING DEVICE HAVING ELECTROMAGNETIC INDUCTION HEATER

BACKGROUND OF THE INVENTION

The present invention relates to a cooking heater and, particularly, to a cooking heater capable of being used as either an electromagnetic induction heater or a high frequency induction heater.

An example of a conventional electromagnetic cooking heater is shown in FIG. 5, which employs a high frequency induction heater, or microwave oven. In FIG. 5, a housing 1 includes therein a heating room 2, a magnetron 3 for generating high frequency electromagnetic waves, a wave guide 4 for guiding the microwaves into the heating room 2 in which a material 5 to be cooked is disposed, a frying pan 6 which can be removed from the heating room and used for other cooking operations externally of the heater, a turntable 7 on which the frying pan can be mounted, and a motor 8 for driving the turntable 7.

For example, there may a case where the frying pan 6 is first heated by an external heat source such as a gas oven to sear the material 5 thereon and thereafter inserted into the heating room 2 to heat it uniformly with high frequency electromagnetic waves (typically, 2.45 GHz) generated by the magnetron 3, while rotating the turntable 7 by the motor 8.

In the so-called frying pan cooking system mentioned above, it is necessary to bring the frying pan from the external oven for searing to the electromagnetic heater which may be remote from the external oven.

Another conventional cooking heater comprises a high frequency heating device and an electromagnetic induction heating device provided integrally on the high frequency heating device. In this heater, material is induction-heated in the electromagnetic induction heater to sear it and then moved into the high frequency heating device for internal heating. This also requires the material to be moved from the upper electromagnetic device to the high frequency device, which is troublesome. Further, since the distance between an electromagnetic induction heating coil and a magnetic container is selected as large in view of thermal insulation, the coupling efficiency of magnetic flux is low and hence the heating efficency is relatively low compared with cooking with a gas range. Although there is another conventional device in which a shielded heater is provided within a heating room to implement searing, the heating efficiency thereof is also low.

SUMMARY OF THE INVENTION

An object of the present invention is to provide a cooking heater capable of searing a material with high frequency induction heating and then heating it with electromagnetic induction heating without moving it. Since the material to be cooked is not required to be moved from one cooking device to another, the time required for cooking can be reduced.

In order to achieve the above object, a cooking heater according to an embodiment of the present invention comprises a heater room provided with a microwave heating, i.e., a magnetron, a turntable provided within the heating room for mounting a container on which material to be cooked is disposed, and an electromagnetic induction heater having a coil arranged below the heating room for electromagnetic induction heating, the heating room having a bottom constituted by a mesh of non-magnetic metal material with mesh size of 10 to 25.

The metal a mesh may be sandwitched between two layers of dielectric insulating material and the turntable may be formed of dielectric material.

A key for generating an audible signal may be provided on a control panel of the cooking heater for signalling a completion of preheating of the container in the heating room.

The metal mesh constituting the bottom of the heating room serves to restrict the leakage of microwaves (typically, 2.45 GHz) for microwave heating to a permissible range and to allow electromagnetic waves (typically, about 20 to 30 KHz) for electromagnetic induction heating to pass into the heating room, so that both the microwave heating and the electromagnetic induction heating can be done on a material within the same heating room. The "electromagnetic induction heating" is a heating due to eddy current loss in a surface portion of a cooking container of dielectric material induced by an electromagnetic field produced by the coil. Thus, the metal mesh formed from thin metal wires hardly forms eddy current paths and hence is hardly heated, so that it is possible to induce eddy current loss in a surface portion of the material to be cooked as the high frequency magnetic field produced by the coil passes therethrough.

Any deformation of the metal mesh due to thermal expansion caused by the minimized eddy current loss can be absorbed by the dielectric layers sandwitching it.

The dielectric turntable may be not affected by the electromagnetic induction heating and its dielectric loss for microwave frequency is minimized.

By actuating the signalling key on the control panel of the cooking heater, the cooking can be started efficiently upon the signal generated when the preheating of the container within the heating room is completed, resulting in a reduction of the cooking time.

DETAILED DESCRIPTION OF THE PREFERRED EMBODIMENTS

Figure 1:
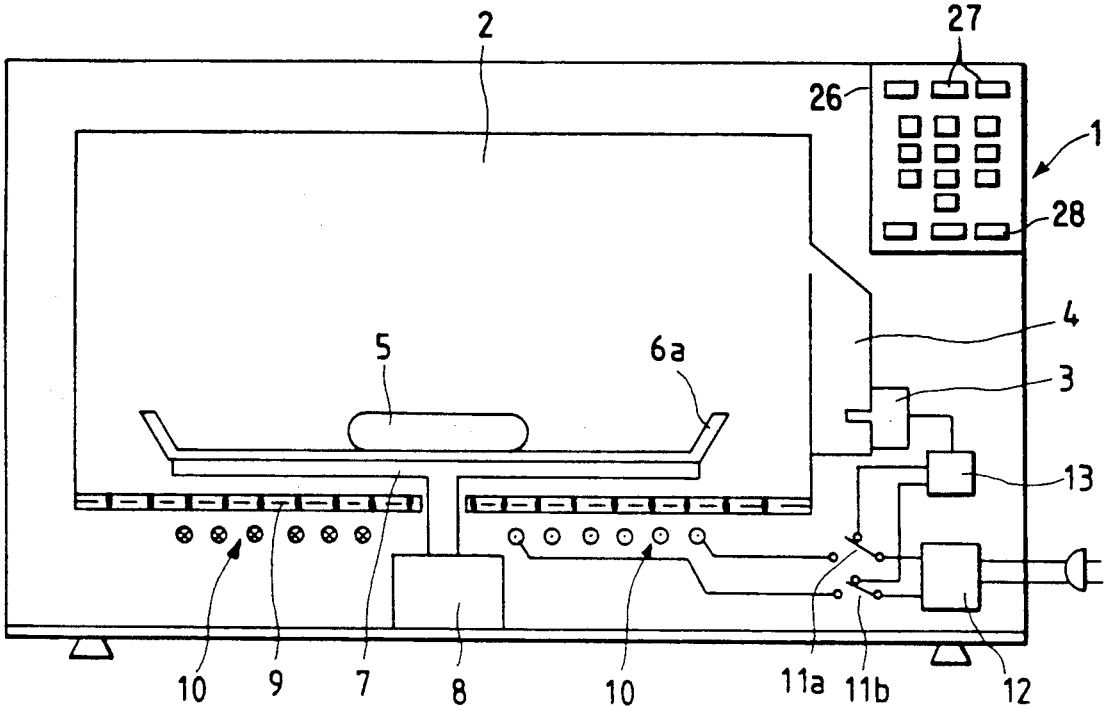
FIG. 1 shows a construction of a cooking heater according to an embodiment of the present invention.
Figure 2:
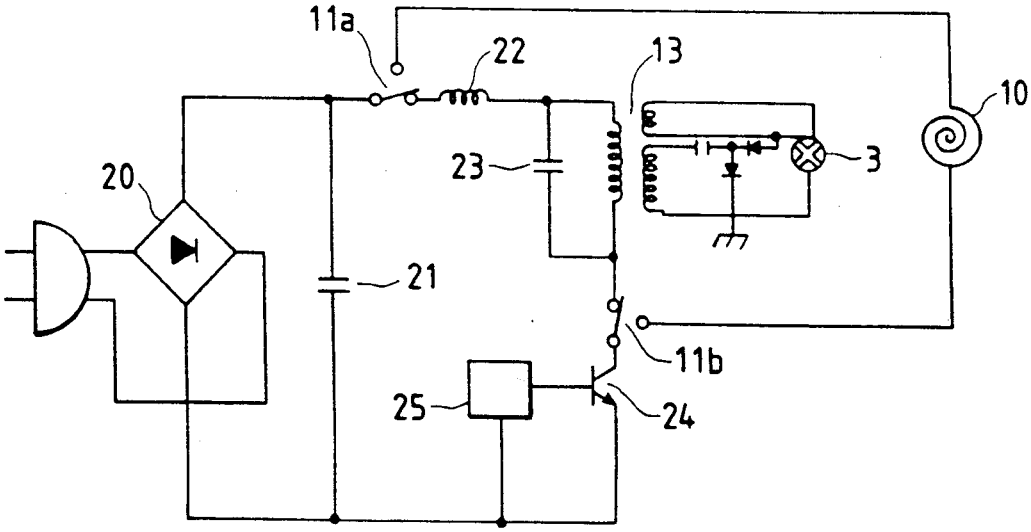
FIG. 2 is an electric circuit diagram of the cooking heater shown in FIG. 1.

An embodiment of the present invention will be described in detail with reference to FIG. 1 showing a construction of a cooking heater and FIG. 2 showing an electric circuit thereof.

In FIGS. 1 and 2, a cooking heater 1 includes a heating chamber or room 2 provided with a wave guide 4 for connecting a magnetron 3 thereto. A bottom portion of the heating room 2 is constituted by a non-magnetic metal mesh 9. A turntable 7 is disposed within the heating room 2, which is driven by a turntable motor 8 through a shaft thereof penerating the metal mesh 2. An induction coil 10 is disposed beneath the metal mesh 9.

A food material 5 is disposed on a container 6*a* of magnetic material such as iron which, in turn, is disposed on the turntable 7 which may be of dielectric material.

A high voltage, transformer 13 is provided for driving the magnetron 3 together with a switching power source 12 connectable to an external commercial a.c. 100 V power source, and a double-pole, double-throw relay having relay contacts 11*a* and 11*b* for selectively connecting the commercial power source to the high voltage transformer 13 or the induction coil 10 to the commercial power source, through the relay.

The high voltage transformer 13 itself is well known and is shown in FIG. 2 schematically. The switching power source 12 is composed of a full wave rectifier 20, a smoothing capacitor 21, a load circuit including a series circuit of an inductor 22, a capacitor 23 which consitutes together with a primary winding of the high voltage transformer 13 a tank circuit and a collector-emitter circuit of a switching transistor 24. It further includes a drive signal generator 25 for driving the switching transistor 24.

In operation, an a.c. 100 V is rectified by the rectifier 20 and supplied to either the high voltage transformer 13 or the electromagnetic induction coil 10. The selection therebetween is performed manually through the relay. It may be possible to provide a selection key on the control panel 26 having a plurality of function keys 27. When the high voltage transformer 13 is selected, energy accumlated in the tank circuit is transformed thereby to produce a high voltage by which the magnetron 3 generates high frequency electromagnetic waves having a frequency typically of 2.45 GHz suitable to excite water molecules of the material to be cooked. When the electromagnetic induction coil 10 is selected, the material 5 is heated by eddy current loss in its surface portion.

In order to heat the container 6*a* of magnetic material by the coil 10, the turntable 7 and the bottom of the heating room 2 must be made of non-magnetic material which is not affected by electromagnetic waves having a frequency of 20 to 30 KHz. On the contrary, in order to confine microwaves (2.45 GHz) generated by the magnetron 3 within the heating room 2, the bottom of the heating room 2 must be of metal.

The inventors of this invention have found that a mesh formed by plane-weaving thin stainless steel wires (JIS No. SUS304) which are non-magnetic material blocks 2.45 GHz microwaves while coupling 20 to 30 KHz electromagnetic waves without loss. Further, it has been found that, in order to shield such microwaves within a permissible range, the size of the stainless steel mesh must be at least 10 mesh and that, in order to restrict the loss of 20-30 KHz waves to a few percent or lower, the size must be 25 mesh at most. Therefore, by selecting the mesh size of the bottom of the heating room 2 from a range in 10 to 25 mesh, it is possible to perform the high frequency (2.45 GHz) induction heating and the electromagnetic (20-30 KHz) induction heating within the same heating room.

Figure 4:
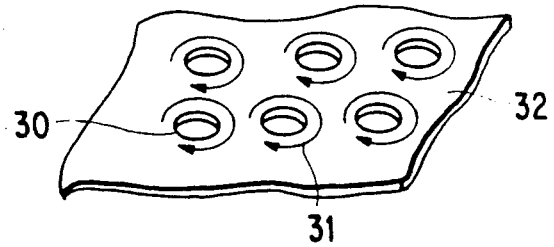
FIG. 4 illustrates the generation of eddy currents in a metal mesh formed by the punching of a metal sheet.
Figure 5:
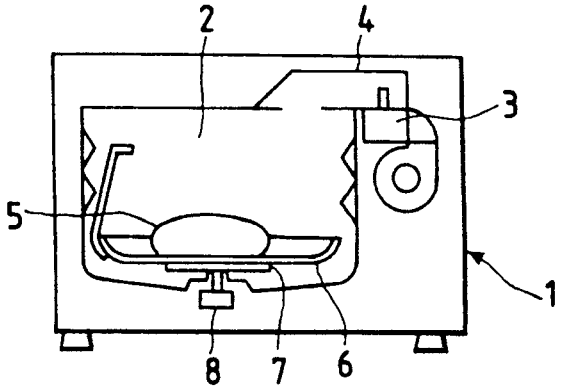
FIG. 5 PRIOR ART
FIG. 5 shows a conventional microwave cooking heater.

In a case where such bottom mesh is formed from a punched metal sheet 32, it is heated too much within a very short time due to eddy currents flowing around each punched hole 30, as shown by the arrows 31 in FIG. 4.

An example of cooking with the heater constructed as mentioned above will be described with reference to the heating of meat. At first, a frying pan 6*a* is put on the turntable 7 and a "frying pan" key on the control panel 26 of the cooking heater is depressed so that the relay contacts 11*a* and 11*b* are thrown onto the side of the electromagnetic induction coil 10. After preheating the frying pan 6*a* for about 2 minutes, the pan 6*a* is oiled and then a meat is put thereon and suitably seared by a subsequent electromagnetic induction heating by the coil 10 to fix the protein in the surface portion of the meat. By restarting the cooking after the searing step is completed, the relay contacts 11*a* and 11*b* automatically connect the power source to the magnetron 3 to heat an internal portion of the meat by microwave heating. Thus, a well cooked steak is obtained without loss of meat juice within a shorter heating time compared with that required for the conventional cooker.

Figure 3:
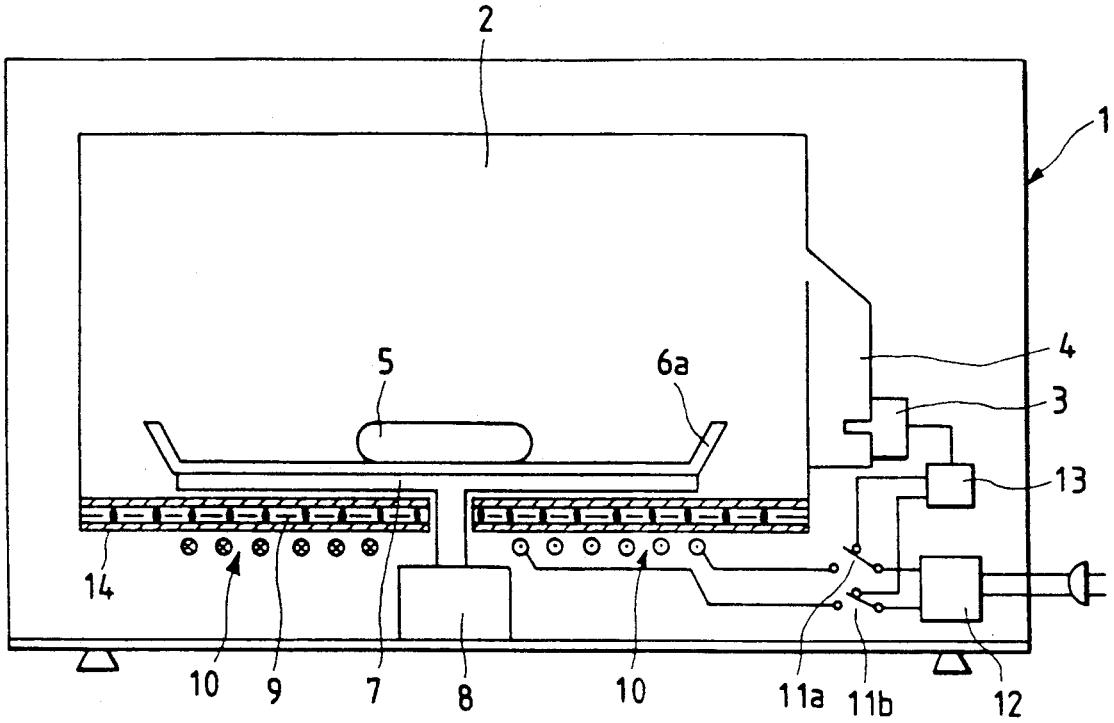
FIG. 3 shows a construction of a cooking heater according to another embodiment of the present invention.

FIG. 3 shows another embodiment of the mesh bottom of the heating room. In FIG. 3, the mesh 9 is sandwiched between layers 14 of electrically insulating dielectric material and fixed in place by means of silicone adhesive.

Although the mesh 9 is relatively hardly heated by electromagnetic induction, it is somewhat heated and deformed thereby. Such deformation of the mesh is absorbed by the insulating layers 14.

The turntable 7 of the present invention may be formed of dielectric material so that there is no effect of electromagnetic waves of 20 to 30 KHz thereon. For dielectric material usable in the present invention, ceramic material is preferable since it is possible to minimize dielectric loss at 2.45 GHz.

A warning means such as buzzer may be provided on the cooking heater according to any of the mentioned embodiments and a warning key 28 may be provided on the control panel thereof. The warning means may be capable of setting a preheating time of the pan 6*a* and, when the key is actuated, an audible signal is generated by the buzzer when the preheating time lapses. Thus, it is possible to perform cooking without any time gap between the completion of preheating and the start of the cooking, contributing to a shortening of cooking time.

I claim:

1. A cooking heater, comprising: a housing provided thereon with an operation control panel including a plurality of function keys, a cooking chamber defined in said housing, said cooking chamber having a bottom formed by a non-magnetic metal mesh having a size in a range from 10 mesh to 25 mesh, a turntable disposed within said cooking chamber for containing food to be cooked, a magnetron for generating microwaves, a wave guide for guiding said microwaves into said cooking chamber, an electromagnetic induction coil disposed below said non-magnetic metal mesh, and means for selectively coupling electric power to one of said magnetron and said induction coil.

2. The cooking heater claimed in claim 1, wherein said non-magnetic metal mesh is sandwiched between two layers of dielectric insulating material to form a laminated structure.

3. The cooking heater claimed in claim 1 or 2, wherein said non-magnetic metal mesh is formed by plane-weaving thin stainless steel wires.

4. The cooking heater claimed in claim 1 or 2, wherein said turntable is formed of dielectric material.

5. The cooking heater claimed in claim 1 or 2, further comprising a warning means for setting a preheating time and producing an audible warning signal when the preheating time elapses and wherein said function keys includes a preheating key and said warning means is actuated by depression of said preheating key.

* * * * *